US006183827B1

(12) United States Patent
Folchini et al.

(10) Patent No.: US 6,183,827 B1
(45) Date of Patent: Feb. 6, 2001

(54) LID PARTICULARLY FOR FOODSTUFF CONTAINERS AND PROCESS USED FOR ITS MANUFACTURE

(75) Inventors: Enrico Folchini, Occhiobello; Marziano Schiaretti, Ozzano Emilia; Fabrizio Michelini, Ferrara, all of (IT)

(73) Assignee: Pelliconi & C. S.p.A., Bologna (IT)

( * ) Notice: Under 35 U.S.C. 154(b), the term of this patent shall be extended for 0 days.

(21) Appl. No.: 08/930,911

(22) PCT Filed: Feb. 7, 1997

(86) PCT No.: PCT/IT97/00029

§ 371 Date: Oct. 14, 1997

§ 102(e) Date: Oct. 14, 1997

(87) PCT Pub. No.: WO97/29968

PCT Pub. Date: Aug. 21, 1997

(30) Foreign Application Priority Data

Feb. 13, 1996 (IT) ..... B096A0065

(51) Int. Cl.[7] ..... B65D 41/12

(52) U.S. Cl. ..... 428/64.1; 40/311; 215/230; 215/341; 215/347; 428/66.3; 428/66.4; 428/66.5; 428/66.7

(58) Field of Search ..... 428/64.1, 66.3, 428/66.4, 66.5, 66.7; 215/230, 347, DIG. 2, 341; 40/311

(56) References Cited

U.S. PATENT DOCUMENTS 4,835,035 5/1989 Bayer ..... 428/187

FOREIGN PATENT DOCUMENTS 1 504 751 3/1978 (GB) .
1 515 479 6/1978 (GB) .
2 001 079 1/1979 (GB) .
58 083033 5/1983 (JP) .
6-247467 * 9/1994 (JP) .

* cited by examiner

*Primary Examiner*—Nasser Ahmad
(74) *Attorney, Agent, or Firm*—Pillsbury Madison & Sutro LLP

(57) ABSTRACT

A lid for foodstuff containers includes a shell shaped so that it can be fitted over an opening in a container, and a PVC-free seal, bearing an inscription, attached to the bottom of the shell and able to seal the lid to the container; the seal is applied to the bottom of the lid by applying adhesive paint between the bottom and the seal; this paint which can be used to control the adherence of the seal to the bottom, consists of a mixture of synthetic resins and hydrocarbons with added metallic pigment; a film bearing the inscription is applied over the paint, said inscription made using an ink which has a given chemical-physical affinity with the material used for the seal; it is, therefore, easy to detach the seal from the bottom of the lid upon which the inscription is clearly reproduced.

13 Claims, 3 Drawing Sheets

LID PARTICULARLY FOR FOODSTUFF CONTAINERS AND PROCESS USED FOR ITS MANUFACTURE

This application is the national phase of international application PCT/IT97/00029, filed Feb. 7, 1997 which was designated the U.S.

TECHNICAL FIELD

The present invention relates to a lid, as it is generally known, for foodstuff containers, in particular for use in prize competitions in which an inscription is placed on the inside of the lid.

In particular, it should be noticed that the lid concerned may be used to seal glass bottles designed to contain liquid foodstuffs, under pressure or not, which may or may not undergo heat treatment. In such cases, the said lid is a crown cap which guarantees the seal between the air and the container. More precisely, the cap in question has a removable PVC—free seal with an inscription on the side which faces the bottom of the lid. PVC—free means those materials which do not contain polyvinyl chloride, the use of which continues to be reduced, especially in Northern European countries. The afore-mentioned internal inscription makes the lids particularly suitable for use in prize competitions.

BACKGROUND ART

At present, in accordance with the prior art and for particular commercial requirements, three different types of caps suitable for prize competitions are used.

The first type consists of a cap in the form of a metallic shell, the internal side having a bottom upon which an opaque PVC seal is applied after treatment with adhesive paint. Given its affinity with the paint, the said seal is easily detached, so that an inscription present on the bottom of the cap can be read.

The second type of cap, again having an opaque PVC seal, differs from the first in that the inscription is made in such a way that it is transferred from the shell to the seal itself: therefore, this type of cap is ideal for use when the seal must be used as proof of a win, since it is easier to send a seal rather than the entire cap.

The third type of cap has a transparent seal (PVC or PVC—free) which cannot be detached from the bottom of the cap. There is an inscription on the bottom of the cap itself, clearly visible through the seal. However, this cap is impractical for use in prize competitions, since the entire cap is required as proof of a win, being less convenient than the second type of cap, since, as already indicated, it is easier to post a seal than a cap. A further disadvantage of this third type of cap is that a sufficiently opaque bottle is required, to prevent the inscription being read from the outside of the bottle.

None of the three types of PVC-based crown caps made according to the prior art can be marketed in those states in which the law forbids the use of PVC crown caps.

To comply with such regulations and requirements and, at the same time, obtain a cap which has an easily detachable PVC—free seal, a new technology designed to control the adhesion of the PVC—free material to the cap is needed.

DISCLOSURE OF THE INVENTION

The main object of the present invention is to overcome the afore-mentioned disadvantages of the known types of caps, by providing a cap with a PVC—free seal which, if necessary, can easily be detached from the bottom of the lid shell.

A further aim of the present invention is to create an inscription which is easily and clearly transferable to the seal, without the seal adhering to the adhesive paint spread on the bottom of the lid, using a process which is able to control the adhesion of the seal to the shell of the lid.

Another aim of the present invention is to provide a simple, reliable operating process.

BRIEF DESCRIPTION OF THE DRAWINGS

The technical specifications of the present invention and the process used, according to the afore-mentioned aims, are clearly described in the claims, and the advantages are apparent from the detailed description which follows with reference to the accompanying drawings, which illustrate a preferred embodiment, and in which:

DESCRIPTION OF THE PREFERRED EMBODIMENTS

Figure 1:
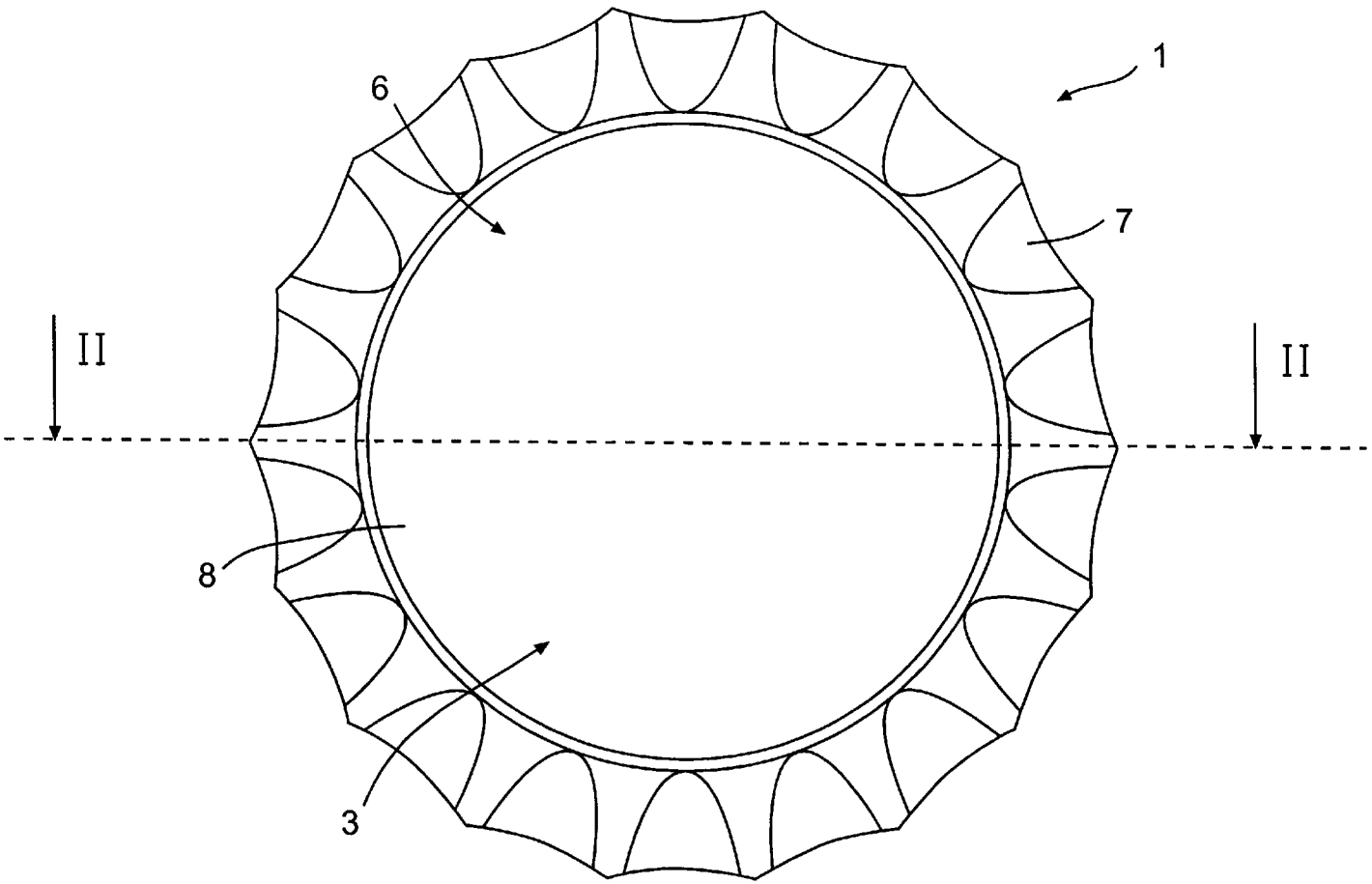
FIG. 1 is a schematic plan view from below of a lid as disclosed.

In the embodiment illustrated, the lid consists of a cap for bottles designed to contain liquid foodstuffs which must not come into contact with the atmosphere. More specifically, it is a crown cap, generally used to seal glass bottles containing liquid foodstuffs which may or may not be under pressure, such as water, wine, various beverages, etc.

With reference to the accompanying drawings, the lid disclosed consists of a crown cap, indicated as a whole by the numeral 1.

The said cap 1 basically consists of a metallic shell 3, which can be attached to the top of a bottle (not illustrated), and has a concave surface 5 defining a bottom 6, the edge of which is delimited by a crown 7. The cap 1 also has a PVC—free seal 8 (i.e.: made of a material which does not contain polyvinyl chloride) which is approximately the same size as the bottom 6.

Figure 2:
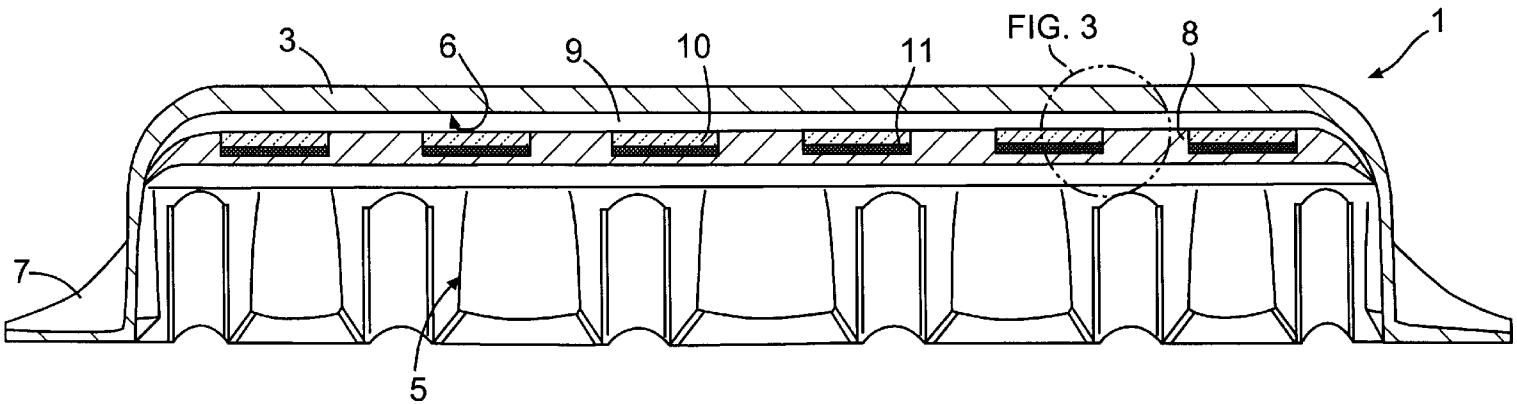
FIG. 2 is a schematic view of the lid, according to cross-section II—II shown in FIG. 1, with some parts cut away to better illustrate others.
Figure 3:
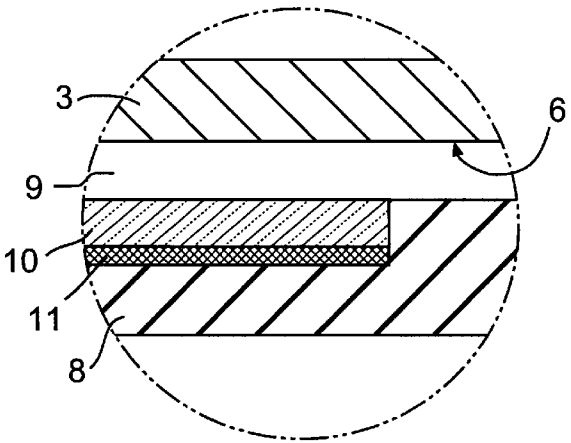
FIG. 3 is an enlarged detail of the drawing of the crown cap with detached seal shown in FIG. 2.

Paint 9 is used to stick the seal 8 to the bottom 6 (see FIG. 2).

More precisely, the method used to manufacture the crown cap 1 in question begins with a sheet of metal. The lithographic print defining the designs which will appear on the outside of the cap (usually the product trade-mark) are made on one side of this sheet of metal, whilst the afore-mentioned layer of paint 9 is spread on the other side.

The sheet then goes through the stages of cutting and formation of the shell which create the cap 1. Finally, the cap 1 is passed inside a heating station, where the paint is melted and acts as an adhesive for a seal 8 which is poured into the cap 1, then formed by a corresponding press which gives it the desired shape.

For the present invention, the said paint 9 consists of a mixture of synthetic resins and a hydrocarbon compound with added metallic pigment that is neither heavy nor toxic.

The addition of the metallic pigment allows the adhesion of the seal 8 to the bottom 6 of the cap 1 to be controlled: the greater the concentration of the metallic pigment in the hydrocarbon compound, the more the paint 9 reproduces the chemical-physical specifications of the metallic shell 3.

As a result, the adhesion of the seal 8 to the shell 3 is reduced.

More specifically, the metallic pigment may be dosed in such a way as to ensure that the seal 8 remains stuck to the bottom 6 of the cap 1 and, at the same time, make it easy to detach by lifting it off with, for example, a fingernail.

The paint 9 described basically consists of the following variable quantities of components, in the weight percentages indicated.

2-butoxyethanol 15–25% aromatic hydrocarbons C9–C11 5–15% n-butanol 1–5% xylol 1–5% isobutanol 5–15%

2(2-butoxyethoxy) ethanol 1–5% synthetic resins 30–40% methyl isobutyl ketone 1–5% methoxypropanol 10–20% metallic pigments 1–5%

A film 10 of transparent or pigmented material is placed between the paint 9 and the seal 8, said film bearing an inscription 11, obtained using a UV ink. The latter is a special ink, which can be dried and fixed in UV ray ovens. The film 10 is only placed on a limited painted area of the bottom 6 of the cap 1, where the inscription 11 is made.

The said film 10 basically consists of organic pigments, aliphatic hydrocarbon fractions, polyester-, amino- and wax resins. Thanks to the composition of the film 10, the inscription 11 with UV ink positioned precisely over the area treated with the film 10 only slightly adheres to the film 10 and, as a result, adheres much more to the seal 8 with which the inscription 11 is in contact.

The UV ink basically consists of: organic pigments, amino-and/or polyester- and/or epoxy-resins, acrylic oligomers consisting of di- and tri-esters of polyfunctional alcohols with acrylic acid, benzophenone and/or complex ketones or their derivatives, polyethylene waxes.

The following is a description of the process for the creation of the structure of the lid 1.

First, the paint 9 is prepared by mixing the synthetic resins with a hydrocarbon compound to which a metallic pigment has been added.

Then, the paint 9 is spread on one side of a sheet of material, normally metallic, with mechanical specifications suitable for obtaining the shell 3 of the cap 1.

Depending on specific requirements, the said sheet consists of chrome-plated steel, tin-plated steel, or stainless steel and aluminium.

The paint 9 is then dried in conventional ovens at temperatures which vary between 150 and 250° C., this drying process lasting 5–20 minutes. The temperature is preferably kept within the smallest interval of 180–190° C. for a period of 11–13 minutes.

In a later stage of the process, if the cap 1 is to be used to set commercial prize competitions, the film 10 is applied over the paint 9. It is applied by using a special lithographic plate to lay the film 10 only in the painted areas in which the inscription 11 is to be obtained.

The film 10 is then dried in a second drying operation, identical to that used to dry the paint 9.

In another stage, the inscription 11 is made on the painted areas covered by the film 10. The inscription 11 is preferably made using the same plate that was used to apply the film 10, and using UV ink with the afore-said specifications and composition.

The sheet thus treated is ready to be cut, thus obtaining the shells. A PVC—free seal 8 is attached to each of the shells, so as to guarantee the seal between the cap 1 and the bottle.

Figure 4:
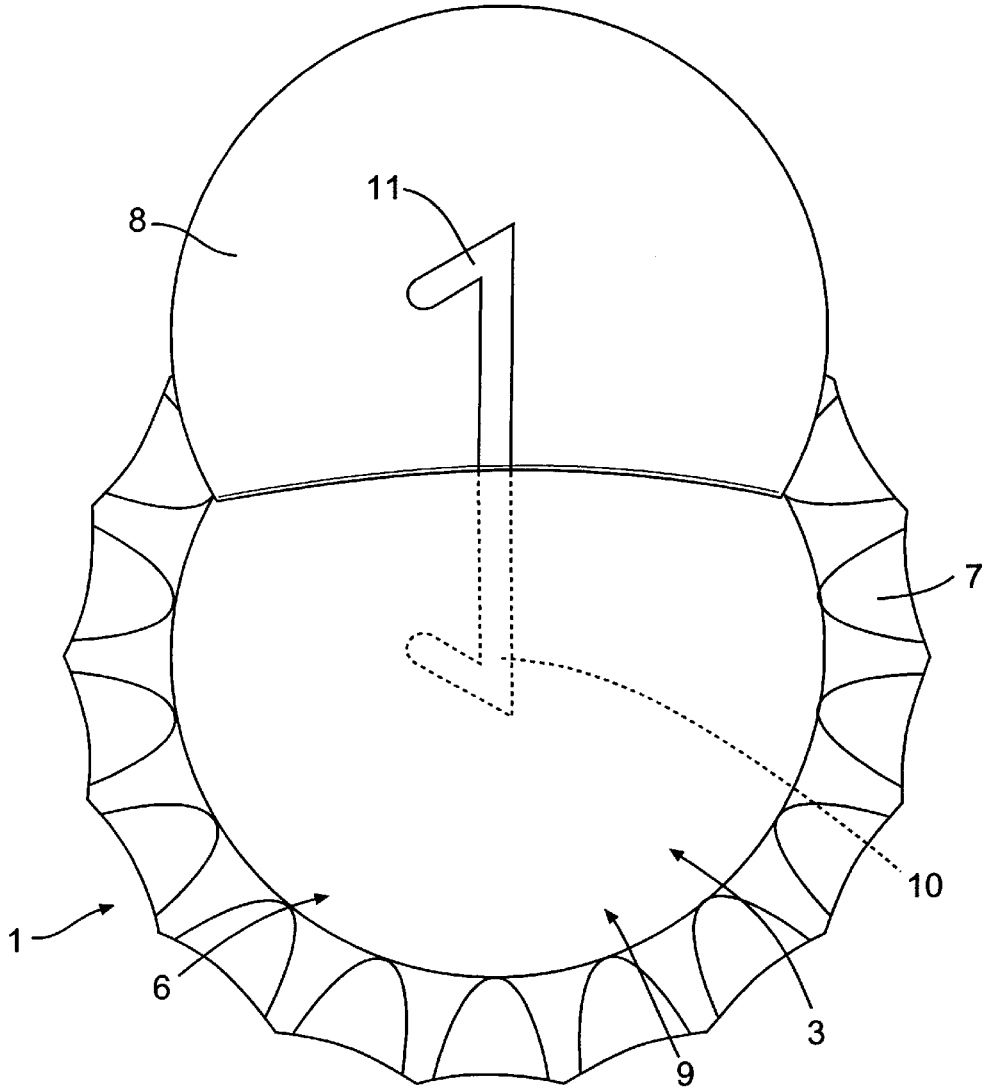
FIG. 4 shows a lid as illustrated in the previous figures, in a configuration in which the seal is partially detached and with the transfer of an internal inscription.

The above description clearly indicates one of the advantages of the present invention. That is to say, when the seal 8 is detached from the bottom 6 of the cap 1, the seal 8 bears only the inscription 11 (as clearly shown in FIG. 4).

The use of a paint which contains a metallic pigment allows the stage in which the seal 8 is detached from the lid 1 to be controlled, leaving the mechanical specifications and seal of the crown cap as a whole unchanged, this being an important factor for the bottlers who use it.

In particular, this bilateral control of the adherence of the seal 8 to the lid 1 and limited adherence of the inscription 11 to the film 10 at the bottom of the lid 1 is, above all, a result of the identification of components suitable for obtaining a substance compatible with and acting upon the PVC—free material, without the latter losing any of the advantageous specifications present.

The present invention may be subject to numerous modifications and variations, all of which are encompassed by the design concept. Moreover, all parts may be substituted with technically equivalent parts.

What is claimed is:

1. A lid for a foodstuff container comprising:

a shell shaped lid for being fitted over an opening in the container, the shell having a bottom whose shape corresponds to the opening of the container, the bottom having a surface facing the containers interior when the shell is fitted over the opening;

a seal, made of material which is free from polyvinyl chloride, the seal having a size substantially corresponding to the surface of the bottom, being attached to the bottom, over the surface, and sealing the shell onto the container; and an adhesive paint applied over the surface of the bottom to join the seal to the bottom, the paint including a hydrocarbon compound and at least one metallic pigment to reduce the effective adhesive area of the seal to the bottom, wherein the seal is detachable from the bottom of the shell.

2. The lid as described in claim 1, wherein the paint comprises:

2-butoxyethanol, aromatic hydrocarbons C9–C11, n-butanol, xylol, isobutanol,

2(2-butoxyethoxy) ethanol, synthetic resins, methyl isobutyl ketone, methoxypropanol, and metallic pigments.

3. The lid as described in claim 2, wherein the paint contains the components in the following weight percentage amounts:

15–25% 2-butoxyethanol,

5–15% aromatic hydrocarbons C9–C11,

1–5% n-butanol,

1–5% xylol,

5–15% isobutanol,

1–5% 2(2-butoxyethoxy) ethanol,

30–40% synthetic resins,

1–5% methyl isobutyl ketone,

10–20% methoxypropanol, and

1–5% metallic pigments.

4. A lid for a foodstuff container comprising:

a shell shaped lid for being fitted over an opening in the container, the shell having a bottom whose shape corresponds to the opening of the container, the bottom having a surface facing the container's interior when the shell is fitted over the opening;

a seal, made of material free from polyvinyl chloride, the seal having two sides and a size substantially corresponding to the surface of the bottom, being attached to the bottom over the surface, and sealing the shell onto the container;

an adhesive paint applied over the surface of the bottom to join the seal to the bottom, the paint including a hydrocarbon compound and at least one metallic pigment, the metallic pigment being dosed with respect to the hydrocarbon compound in such a way the paint reproduces part of the chemical and physical specifications of the shell, wherein the seal is stuck to the bottom of the shell and, at the same time, is detachable from the shell.

5. The lid as described in claim 4, further comprising:

an inscription reproduced on the side of the seal which adheres to the paint on the shell; and a non-stick film positioned between the inscription and the paint for reducing the adhesion of the inscription to the paint and for making the inscription adhere to the seal when the seal is detached from the bottom.

6. The lid as described in claim 5, wherein the film comprises:

organic pigments, aliphatic hydrocarbon fractions, and at least one of polyester-, amnino-, and wax resins.

7. The lid as described in claim 5, wherein the film is made of a transparent material.

8. The lid as described in claim 5, wherein the film is made of a pigmented material.

9. The lid as described in claim 5, wherein the inscription is made using a UV ink, which can be dried in UV ray ovens.

10. The lid as described in claim 9, wherein the UV ink comprises:

organic pigments, at least one of amino-, polyester-, and epoxy-resins, acrylic oligomers consisting of di- and tri-esters of polyfunctional alcohols with acrylic acid, at least one of benzophenone and complex ketones or their derivatives, and polyethylene waxes.

11. The lid as described in claim 1, wherein the lid is a bottle cap comprising:

a metallic shell in a shape of a crown; and a seal which is free from polyvinyl chloride.

12. The lid as described in claim 1, wherein the metallic pigment comprises a metal which is neither heavy nor toxic.

13. A lid for a foodstuff container comprising:

a shell shaped lid for being fitted over an opening in the container, the shell having a bottom whose shape corresponds to the opening of the container, the bottom having a surface facing the container's interior when the shell is fitted over the opening;

a seal, made of material which is free from polyvinyl chloride, the seal having two sides and a size substantially corresponding to the surface of the bottom, being attached to the bottom over the surface, and sealing the lid onto the container;

an inscription reproduced on the side of the seal which is attached to the paint;

an adhesive paint applied over the surface of the bottom to join the seal to the bottom, the paint including a hydrocarbon compound and at least one metallic pigment, the metallic pigment reducing the effective adhesive area of the seal to the bottom; and a non-stick film having areas substantially corresponding to those of the inscription, the non-stick film being positioned between the inscription and the paint for causing the inscription to adhere to the seal when the seal is detached from the bottom.

* * * * *